US005580041A

United States Patent [19]

Nakayama

[11] Patent Number: 5,580,041

[45] Date of Patent: Dec. 3, 1996

[54] SHEET RECEIVING AND STACKING APPARATUS

[75] Inventor: Koji Nakayama, Ushiku, Japan

[73] Assignee: Riso Kagaku Corporation, Tokyo, Japan

[21] Appl. No.: 332,770

[22] Filed: Nov. 1, 1994

[30] Foreign Application Priority Data

Nov. 12, 1993 [JP] Japan ..... 5-283629

[51] Int. Cl.[6] ..... B65H 29/34

[52] U.S. Cl. ..... 271/189; 271/207; 271/209; 271/220

[58] Field of Search ..... 271/207, 209, 271/220, 223, 224, 189

[56] References Cited

U.S. PATENT DOCUMENTS

| | | | |
|---|---|---|---|
| 3,420,519 | 1/1969 | Edwards . | |
| 4,083,552 | 4/1978 | Sioman . | |
| 4,469,321 | 9/1984 | Geschwindner | 271/189 X |
| 4,938,657 | 7/1990 | Benson et al. | 271/209 X |
| 4,997,176 | 3/1991 | Hain | 271/189 X |
| 5,451,044 | 9/1995 | Nakayama | 271/209 X |

FOREIGN PATENT DOCUMENTS

| | | | |
|---|---|---|---|
| 57-81049 | 5/1982 | Japan . | |
| 6469449 | 3/1989 | Japan | 271/220 |
| 5-10367 | 2/1993 | Japan . | |

*Primary Examiner*—David H. Bollinger
*Attorney, Agent, or Firm*—Kanesaka & Takeuchi

[57] ABSTRACT

A sheet receiving and stacking apparatus includes a base table with a stacking section for stacking a rectangular sheet, and a guide device for receiving the rectangular sheet and guiding the rectangular sheet to the stacking section of the base table. The guide device has a plurality of guide sections rotating in contact with the rectangular sheet above said stacking section.

5 Claims, 3 Drawing Sheets

SHEET RECEIVING AND STACKING APPARATUS

BACKGROUND OF THE INVENTION

1. Field of the Invention

The present invention relates to a sheet receiving and stacking apparatus for receiving and stacking plastics sheets and other kinds of paper which are rectangular sheets and, more particularly, to a delivery apparatus in an image forming apparatus such as a printing apparatus.

2. Description of the Related Art

Generally, as a sheet receiving and stacking apparatus for receiving and stacking rectangular sheets, a delivery apparatus provided at the discharge section of a printing apparatus has been known. This type of delivery apparatus 1, as shown in FIG. 1, commonly has a base table 6 for receiving printed paper 3, a pair of parallel side boards 4, 4 provided nearly vertically on both sides of the base table 6 in a direction of receiving of the paper 3, and an end plate 5 provided at the forward end of the base table 6 in the direction of reception of the paper 3. Both side edges of the printed paper 3 discharged out of the printing section of the printing apparatus 2 are received between the two side boards 4, 4 which are disposed parallel and generally equal to the width of the printed paper 3. The leading edge of the ejected paper 3 strikes the end plate 5 located at front and floats down to be stacked on the base table 6.

In such a delivery apparatus 1, when printing is performed at a low image-printing rate on the paper 3, that is, in the case of a small amount of printing ink to be transferred to the paper 3, the paper 3 is discharged out of the printing apparatus 2 without changing its flat form; therefore there will occur no problem about the stacking of the paper 3 in the delivery apparatus 1. However, in the case of a high image-printing rate, for example when much of ink has been transferred to the paper 3 as in solid printing, the upper surface of the paper 3 to which the ink has been transferred extends largely to curl largely downwardly into an upwardly swollen form. The paper 3 discharged out of the printing apparatus 2, therefore, will be stacked in a disorderly fashion on the base table 6.

To solve this problem, there has been a printing apparatus 7 of known art which, as shown in FIG. 2, is provided with an auxiliary paper discharge member 8 at the entrance of the delivery apparatus 10 mounted in the paper delivery section. This auxiliary member 8 holds upwardly both side edges of the paper 9 in a direction of travel of the paper 9 that has been discharged out of the printing apparatus 7, bending the paper 9 into a form of U letter in the delivery state to thereby provide the paper 9 with stiffness and to thereby prevent the paper 9 from being largely curled with the effect of ink and stacked on the delivery apparatus 10 in a disorderly fashion.

Another apparatus which curves the paper into a U-letter form has been disclosed in Japanese Utility Model Laid-Open No. Hei 5-10367. This apparatus has a pair of side boards disposed to face each other at a spacing on the delivery table, a pair of guide members provided on the pair of side boards so disposed as to face each other and protrude on the delivery table, and guide members driving means for driving the guide members by turning the guide members simultaneously with the delivery operation of the image forming apparatus.

The prior art delivery apparatus described above, however, has such a problem that both side edges of the paper 9 are partly held upwardly when the aforesaid auxiliary paper discharge member 8 is employed, but other portion of the paper 9 apart from the auxiliary paper discharge member 8 becomes free; the paper 9, therefore, is still affected by the ink to curl largely with the ink, resulting in unevenly stacked paper. In the delivery apparatus in which the guide members provided on the side boards are forced to move in and out by the guide means driving member in synchronization with the delivery of paper from the image forming apparatus, it is difficult to control the guide member driving means in accordance with the hardness of the paper, or a difference in the stiffness of the paper, which is determined by a difference in thickness and weight which depend upon the kind of the paper. Besides, the construction of the delivery apparatus required for mounting the guide member driving means will become complicated, which will cause a trouble to occur and raise a manufacturing cost.

SUMMARY OF THE INVENTION

It is an object of the present invention to provide a sheet receiving and stacking apparatus of simple constitution for evenly stacking even such printed paper subjected to curling with the effect of ink.

To solve the above-described problems, the invention according to a first aspect provides a sheet receiving and stacking apparatus, which has a base table provided with a stacking section for stacking rectangular sheets, and guide means for receiving the rectangular sheet and guiding the rectangular sheet to the stacking section of the base table; in this apparatus, the guide means has a plurality of guide portions which rotate in contact with the square sheet above the stacking section.

The sheet stacking and receiving apparatus of a second aspect has a base plate provided with a stacking section for stacking rectangular sheets, and a guide means for receiving the rectangular sheets and guiding the rectangular sheets to the stacking section of the base plate; the guide means comprising a body rotatably supported in a position off the stacking section, and a guide portion which, provided on the body, contacts the rectangular sheet above the stacking section.

The sheet stacking and receiving apparatus of a third aspect is characterized in that, in the sheet stacking and receiving apparatus of first and second aspects, the body of the guide means is a cylindrical member having a horizontally arranged rotating shaft, and the guide portion of the guide means is a plate-like member provided in parallel with the rotating shaft of the body on the outer peripheral surface of the body.

The apparatus of a fourth aspect is a sheet stacking and receiving apparatus, which is characterized in that, in the sheet stacking and receiving apparatus of the third aspect, the guide means has a pair of side boards which define the stacking section of the base table in parallel with the direction of feed of the rectangular sheet, and the guide portion protrudes from the window formed in the side board and is positioned on the stacking section.

Rectangular sheets printed at the image forming apparatus are discharged onto the stacking section of the base table. The rectangular sheet is then received by the guide portion of the guide means, bending downwardly into a U-letter form with its own weight. With the rotation of the guide means body, the guide portion moves off the upper part of the stacking section, allowing the rectangular sheet to float downwardly off the guide portion onto the stacking section.

DESCRIPTION OF THE PREFERRED EMBODIMENT

Further objects and advantages of the present invention can be more fully understood from the following detailed description taken in conjunction with the accompanying drawings.

Hereinafter one preferred embodiment of a sheet receiving and stacking apparatus according to the present invention will be described with reference to the accompanying drawings.

Figure 1:
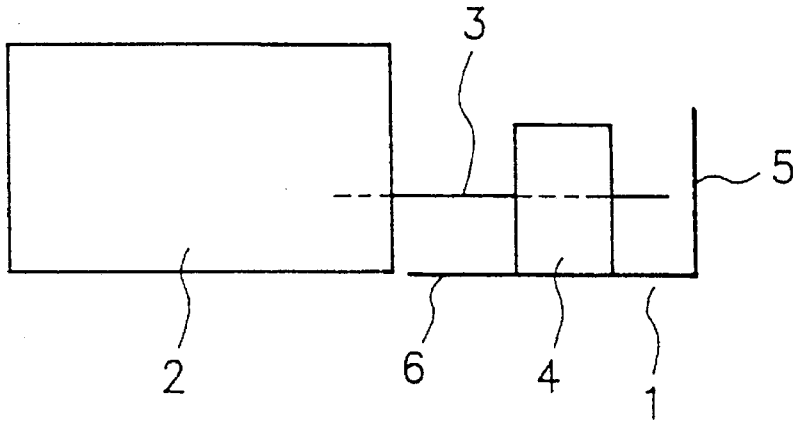
FIG. 1 PRIOR ART
FIG. 1 is a side view showing the constitution of prior art printing apparatus and a delivery apparatus.
Figure 2:
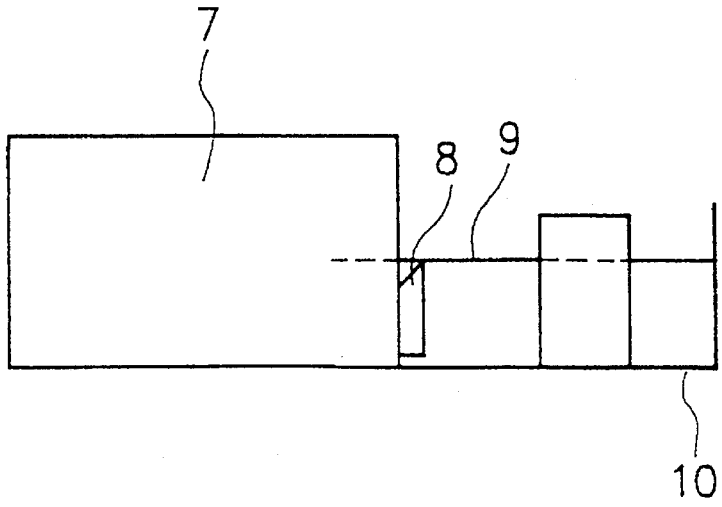
FIG. 2 PRIOR ART
FIG. 2 is a side view showing the constitution of prior art printing apparatus and a delivery apparatus.
Figure 3:
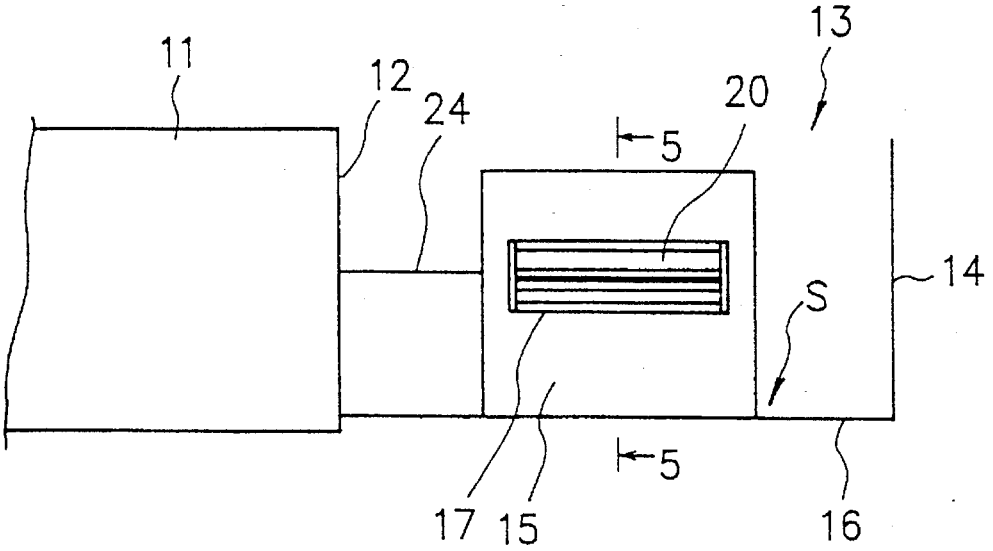
FIG. 3 is a side view of one embodiment of the present invention.
Figure 4:
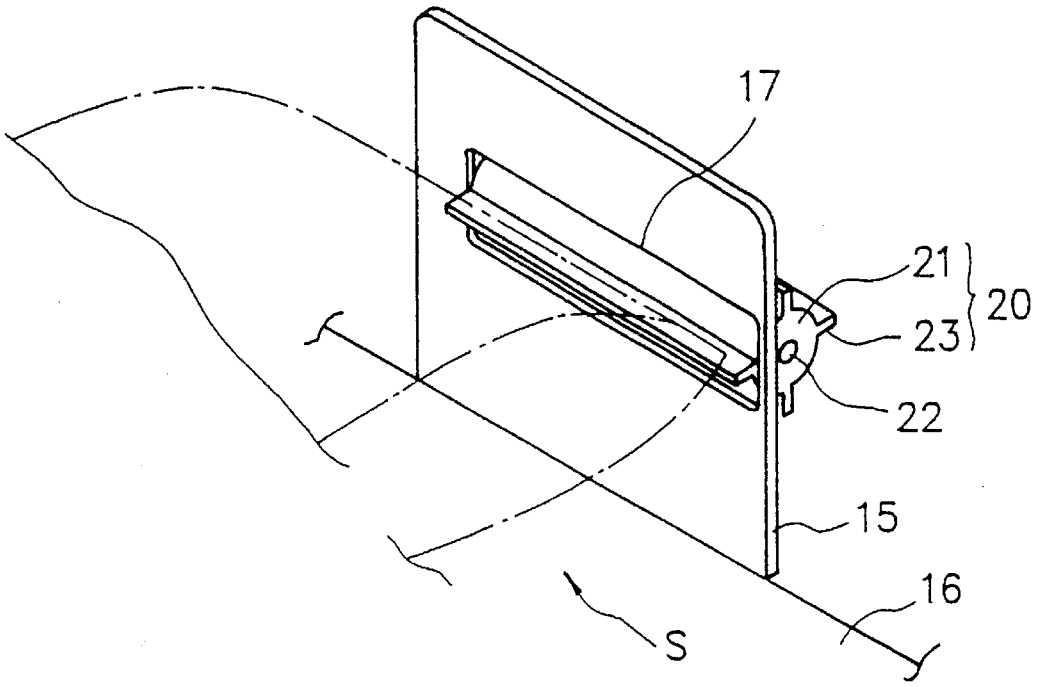
FIG. 4 is an enlarged perspective view of a major portion of the embodiment of the present invention.

FIG. 3 is a side view showing the embodiment of the printed sheet stacking apparatus according to the present invention. FIG. 4 is a perspective view showing enlarged one of a pair of guide means of the sheet stacking and receiving apparatus of the present embodiment.

As shown in FIG. 3, a delivery apparatus 13 which is an apparatus for receiving and stacking sheets is connected to the paper discharge side 12 of a mimeograph machine 11 which is an image forming means. The delivery apparatus 13 has an end plate 14 nearly perpendicularly on the base table 16 and movable towards the mimeograph machine 11, for stopping the leading edge of ejected printed paper as sheets. Also provided nearly at right angles with the end plate 14 are a pair of side boards 15, which are movable towards the inside of the base table 16 in accordance with the size of the paper. The side boards 15 constitute a part of guide means for guiding the printed paper to the stacking section on the base table 16. The sheet stacking section S is defined on the base table 16 by these side boards 15, 15 and the end plate 14.

Figure 5:
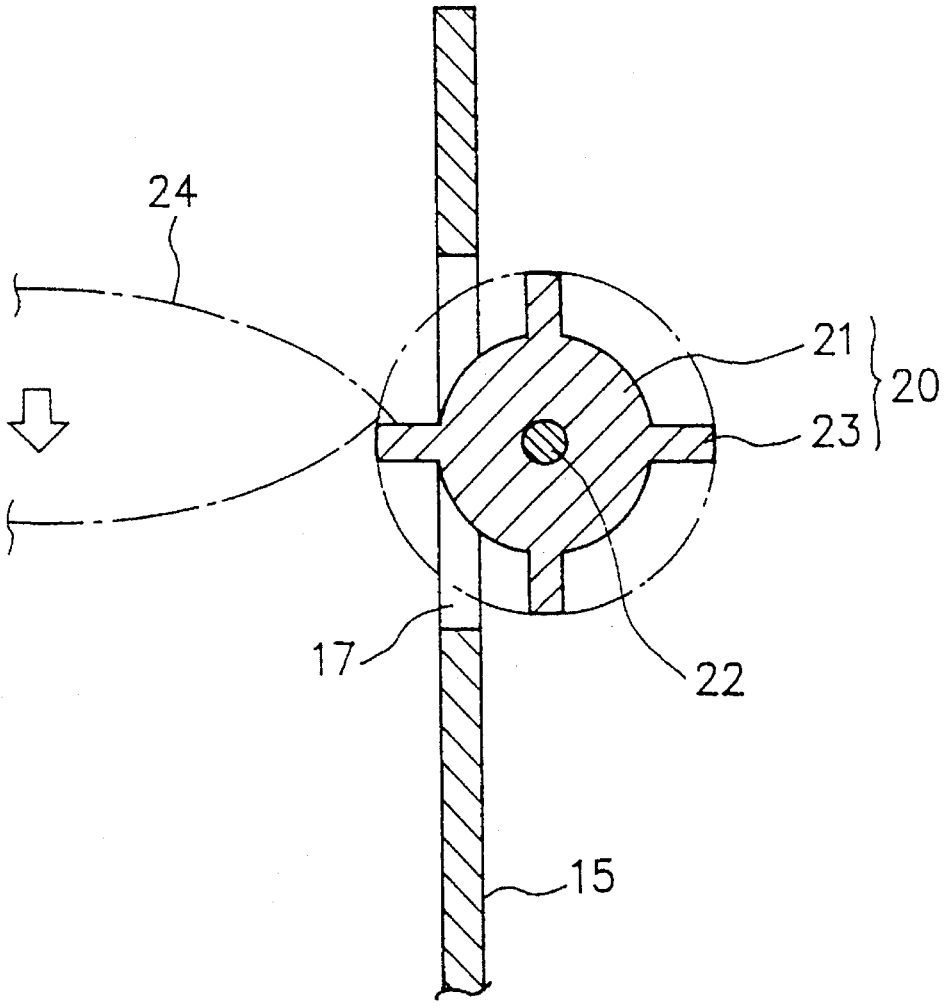
FIG. 5 is a sectional view taken in Line 5—5 of FIG. 3.

As shown in FIGS. 3 to 5, the side board 15 is provided with a window 17. Adjacently to the outside of the side board 15 facing this window 17, a guide member 20 as a guide means is mounted. The guide member 20 is basically composed of a cylindrical body 21. The body 21 is rotatably mounted on a stationary member not illustrated outside of the side board 15, as a rotating shaft 22. The rotating shaft 22 is disposed horizontally, and in parallel with the direction of discharge of the printed paper 24.

On the outer peripheral surface of the body 21 of the guide member 20 are provided four plate-like guide portions 23. The guide portions 23 are in parallel with the rotating shaft 22, and are mounted on the body 21, spaced at an angle of 90 degrees from each other in the direction of rotation of the rotating shaft 22. That is, the guide member 20 has an external shape of a windmill or water wheel having four vanes on the whole.

As shown in FIGS. 4 and 5, the height of the window 17 of the side board 15 in the present embodiment is set to a size large enough to receive the maximum diameter of the guide member 20. The body 21 of the guide member 20 in the present embodiment is rotatable on the outside, not on the inside, of the side board 15. That is, the body 21 is not protruding from the window 17 into the inside of the side board 15. The guide portions 23 are so designed as to protrude successively out through the window 17 of the side board 15, being positioned above the stacking section S.

According to the above-described constitution, when both side edges of the printed paper 24 that has been discharged out of the mimeograph machine 11 are supported by the guide portion 23 of the guide member 20, the guide member 20 rotates on the center of the rotating shaft 22 with the weight of the paper. The printed paper 24, moving downwardly with its own weight, is curved downwardly into a U-letter form as shown in FIGS. 4 and 5 while being supported by the guide portion 23, thus being prevented from curling with ink.

The printed paper 24 that has come off the guide portion 23 floats down onto the stacking section S. The guide portion 23, now free from the printed paper 24, is moved with the weight of the printed paper 24 to the outside of the side board 15 from the window 17. Then, with the rotation of the body 21, another guide portion 23 turns to move over the stacking section S in the side board 15, thereby enabling the reception, by the guide portion, of the printed paper being successively discharged. With the repetition of this operation, the printed paper 24 is evenly stacked on the stacking section S of the base table 16.

In the embodiment described above, the body 21 of the guide member 20 does not enter inside the side board 15, and the printed paper 24 is held only by the plate-like guide portion 23. In this case, a part of the body 21 may be protruded into the side board 15. Furthermore, the apparatus is desired to be of such a constitution that the guide member is rotatable with the weight of the printed paper received, and the printed paper supported has so great weight or weight balance as to be deformed into a desired shape during rotation, and also that the rotating shaft 22 of the guide member 20 is provided with a clicking function in order to await and guide the side edges of the printed paper with only one of the plate-like guide members 23 protruding to the stacking section S at all times.

In the embodiment described above, the guide member has a cylindrical body, but may be of a disc-like shape and besides the number of the guide member is not limited to one or one place per one side board.

For the number and arrangement of the guide member, a plurality of rows and lines may be selected. For a pair of side boards which are nearly vertically disposed on both sides of the base table, in parallel with each other, the same number of guide members are desired to be provided in the same position. The guide members may be provided directly on the side board. The side board may be movable toward the center of the base table similarly to that in the prior art apparatus. Furthermore, the base table or the printed paper stacking section is desired to be curved in a U-letter form.

The embodiment described above pertains to the delivery apparatus of a mimeograph machine; the use of the present invention should not be limited to the delivery apparatus of the mimeograph machine and may be easily selected by those skilled in the art if its object is to uniformly stack plastics films and other kinds of sheets.

According to the present invention, as explained above, it is possible to provide the printed paper, even the solid-printed paper to curl owing to full absorption of ink, with U-letter rigidity during rotation of the guide section that has received the printed paper, on the stacking section. Therefore, the printed paper discharged out of the mimeograph machine can be stacked evenly on the base table.

It should be noted that the present invention is not limited to the embodiment explained above and many modifications are possible within the scope of the invention.

What is claimed is:

1. A sheet receiving and stacking apparatus, comprising:

a base table with a stacking section for stacking a rectangular sheet, and guide means for receiving said rectangular sheet and guiding said rectangular sheet to said stacking section of said base table, said guide means having a pair of side boards provided on the base table parallel to a direction of discharge of the rectangular sheet for defining the stacking section, and a plurality of guide sections rotatably supported near the side boards, each side board having a window therein and one of said guide sections protruding into the stacking section through the window so that when the rectangular sheet is discharged above said stacking section, the rectangular sheet contacts said one of the guide sections to allow the guide sections to rotate by weight of the rectangular sheet to thereby adjust a posture of the rectangular sheet and to automatically fall on the stacking section.

2. A sheet receiving and stacking apparatus as claimed in claim 1, wherein said guide means comprises a body rotatably supported in a position off said stacking section, and the guide sections which are provided on said body and in contact with said rectangular sheet above said stacking section.

3. A sheet receiving and stacking apparatus as claimed in claim 2, wherein said body of said guide means is a cylindrical member having a horizontal rotating shaft, and said guide section of said guide means is a plate-like member provided in parallel with said rotating shaft of said body on the outer peripheral surface of said body.

4. A sheet receiving and stacking apparatus as claimed in claim 1, wherein said guide means includes two bodies, each body being rotatably attached to the side board, said guide sections being fixed to the body and rotating as the body rotates.

5. A sheet receiving and stacking apparatus as claimed in claim 4, wherein each of said bodies and the guide sections attached thereto extend parallel to the stacking section to support the rectangular sheet parallel to the stacking section.

* * * * *